US005974710A

United States Patent [19]

Baldwin

[11] Patent Number: 5,974,710

[45] Date of Patent: Nov. 2, 1999

[54] HOUSE NUMBER DISPLAY SYSTEM

[76] Inventor: Judson E. Baldwin, 2714 20th Avenue Dr., W., Bradenton, Fla. 35205

[21] Appl. No.: 09/134,890

[22] Filed: Aug. 14, 1998

[51] Int. Cl.[6] ..... G09F 13/04

[52] U.S. Cl. ..... 40/576; 40/564; 40/578; 40/620

[58] Field of Search ..... 40/564, 575, 576, 40/578, 620, 623, 658

[56] References Cited

U.S. PATENT DOCUMENTS

| | | | |
|---|---|---|---|
| 1,626,958 | 5/1927 | Norden | 40/576 X |
| 1,709,202 | 4/1929 | Beldin | 40/564 |
| 1,725,008 | 8/1929 | Kugler | 40/623 |
| 1,745,942 | 2/1930 | Miley | 40/658 |
| 2,092,508 | 9/1937 | Hammar | 40/620 |
| 2,766,540 | 10/1956 | Brown et al. | 40/576 X |
| 2,878,606 | 3/1959 | Meijer | 40/576 X |
| 3,398,475 | 8/1968 | Palmer | 40/658 |
| 4,532,579 | 7/1985 | Merryman | 40/576 X |
| 4,693,026 | 9/1987 | Callahan et al. | 40/576 |
| 4,807,378 | 2/1989 | Bell | 40/576 |
| 4,848,017 | 7/1989 | Bailey et al. | 40/576 |
| 4,951,406 | 8/1990 | Lemire | 40/576 |
| 4,953,067 | 8/1990 | Moore | 362/431 |
| 5,007,190 | 4/1991 | Shyu | 40/564 |
| 5,408,773 | 4/1995 | Hwang | 40/547 |
| 5,787,625 | 8/1998 | Yesbick | 40/718 |

*Primary Examiner*—Brian K. Green
*Assistant Examiner*—Andrea Chop
*Attorney, Agent, or Firm*—Joseph N. Breaux

[57] ABSTRACT

A house number display system that includes at least one illumination source for illuminating the numbers identifying the building or house and that is rapidly adapted to display a specific house number. The house number display system includes a front housing portion and a rear housing portion that are connected by a hinge and that are sealable together to define a housing compartment therein; a plurality of number panels; at least one low voltage light assembly installed within the housing compartment; a clip support rod secured across the rear housing portion and positioned within the housing compartment, and a plurality of identical spring loaded number panel support clip assemblies slidably mounted on the clip support rod. The clip support rod has a longitudinal guide channel formed along the length thereof. Each of the spring loaded number panel support clip assemblies has a tube shaped clip mounting flange defining a support rod insertion opening and a guide channel follower extending from the mounting flange into the support rod insertion opening. A horizontal clip extension portion extends radially away from the clip mounting flange and terminates in connection with a spring biased number panel clip including a biasing spring, clamping jaws, and a jaw opening tab. Each number panel includes an opaque portion surrounding a transparent character portion.

12 Claims, 2 Drawing Sheets

HOUSE NUMBER DISPLAY SYSTEM

TECHNICAL FIELD

The present invention relates to house identification systems and more particularly to a house number display system including a front housing portion and a rear housing portion that are connected by a hinge and that are sealable together to define a housing compartment therein; a plurality of number panels; at least one low voltage light assembly installed within the housing compartment; a clip support rod secured across the rear housing portion and positioned within the housing compartment, and a plurality of identical spring loaded number panel support clip assemblies slidably mounted on the clip support rod; the clip support rod having a longitudinal guide channel formed along the length thereof; each of the plurality of identical spring loaded number panel support clip assemblies having a tube shaped clip mounting flange defining a support rod insertion opening and including a guide channel follower extending into the support rod insertion opening, and a horizontal clip extension portion extending radially away from the clip mounting flange and terminating in connection with a spring biased number panel clip including a biasing spring, clamping jaws, and a jaw opening tab; the biasing spring biasing the clamping jaws into a closed position; the jaw opening tab being in connection with one of the jaws such that depressing the jaw opening tab causes the clamping jaws to separate; each of the plurality of identical spring loaded number panel support clip assemblies being slidably mounted on the clip support rod such that the guide channel follower of each tube shaped clip mounting flange is slidably entrapped within the longitudinal guide channel preventing rotation of the clip mounting flange about the clip support rod while allowing the clip support flange to slide back and forth along the clip support rod; each number panel including an opaque background portion surrounding a transparent clear character portion; the opaque background portion being partially insertable between the clamping jaws of one of the spring biased number panel clips.

BACKGROUND ART

It is often difficult for people unfamiliar the with location of a house or building to locate the house or building in the dark. It would be a benefit, therefore, to have a house number display system that could be attached on or near a house or other building to identify the house or building. It would be further benifit to have house number display system that includes at least one illumination source for illuminating the numbers identifying the building or house. Because each building or house is identified by a specific number, it would of course be a further benefit to have a house number display system that allowed a user to rapidly adapt to a specific house number.

GENERAL SUMMARY DISCUSSION OF INVENTION

It is thus an object of the invention to provide a house number display system that is attachable on or near a house or other building to identify the house or building..

It is a further object of the invention to provide a house number display system that includes at least one illumination source for illuminating the numbers identifying the building or house.

It is a still further object of the invention to provide a house number display system that is rapidly adapted to display a specific house number.

It is a still further object of the invention to provide a house number display system that includes a front housing portion and a rear housing portion that are connected by a hinge and that are sealable together to define a housing compartment therein; a plurality of number panels; at least one low voltage light assembly installed within the housing compartment; a clip support rod secured across the rear housing portion and positioned within the housing compartment, and a plurality of identical spring loaded number panel support clip assemblies slidably mounted on the clip support rod; the clip support rod having a longitudinal guide channel formed along the length thereof; each of the plurality of identical spring loaded number panel support clip assemblies having a tube shaped clip mounting flange defining a support rod insertion opening and including a guide channel follower extending into the support rod insertion opening, and a horizontal clip extension portion extending radially away from the clip mounting flange and terminating in connection with a spring biased number panel clip including a biasing spring, clamping jaws, and a jaw opening tab; the biasing spring biasing the clamping jaws into a closed position; the jaw opening tab being in connection with one of the jaws such that depressing the jaw opening tab causes the clamping jaws to separate; each of the plurality of identical spring loaded number panel support clip assemblies being slidably mounted on the clip support rod such that the guide channel follower of each tube shaped clip mounting flange is slidably entrapped within the longitudinal guide channel preventing rotation of the clip mounting flange about the clip support rod while allowing the clip support flange to slide back and forth along the clip support rod; each number panel including an opaque background portion surrounding a transparent clear character portion; the opaque background portion being partially insertable between the clamping jaws of one of the spring biased number panel clips.

It is a still further object of the invention to provide a house number display system that accomplishes some or all of the above objects in combination.

Accordingly, a house number display system is provided. The house number display system includes a front housing portion and a rear housing portion that are connected by a hinge and that are sealable together to define a housing compartment therein; a plurality of number panels; at least one low voltage light assembly installed within the housing compartment; a clip support rod secured across the rear housing portion and positioned within the housing compartment, and a plurality of identical spring loaded number panel support clip assemblies slidably mounted on the clip support rod; the clip support rod having a longitudinal guide channel formed along the length thereof; each of the plurality of identical spring loaded number panel support clip assemblies having a tube shaped clip mounting flange defining a support rod insertion opening and including a guide channel follower extending into the support rod insertion opening, and a horizontal clip extension portion extending radially away from the clip mounting flange and terminating in connection with a spring biased number panel clip including a biasing spring, clamping jaws, and a jaw opening tab; the biasing spring biasing the clamping jaws into a closed position; the jaw opening tab being in connection with one of the jaws such that depressing the jaw opening tab causes the clamping jaws to separate; each of the plurality of identical spring loaded number panel support clip assemblies being slidably mounted on the clip support rod such that the guide channel follower of each tube shaped clip mounting flange is slidably entrapped within the longitudinal guide channel preventing rotation of the clip mounting flange about the clip support rod while allowing the clip support flange to slide back and forth along the clip support rod; each number panel including an opaque background portion surrounding a transparent clear character portion; the opaque background portion being partially insertable between the clamping jaws of one of the spring biased number panel clips. The term "character" is used herein to encompass blank spaces as well as numerical and alphabetical characters. The house number display system optionally includes a resilient housing sealing gasket having adhesive on either side thereof to provide a water-tight seal between the first and the second housing portion. The housing sealing gasket preferably includes a peel off cover on each side thereof. In a preferred embodiment, the low voltage light assembly includes a power supply cord having an illuminated doorbell switch that is powered by the doorbell power supply. In another embodiment the low voltage light assembly includes a low voltage electrical connector that is connectable to the low voltage power supply of a landscape lighting system.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
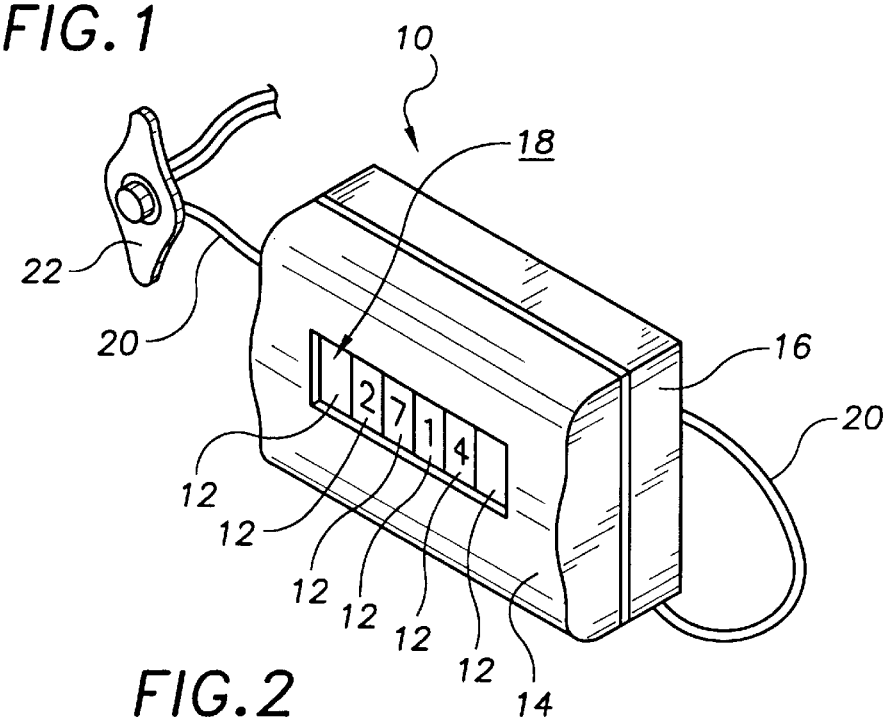
FIG. 1 is a perspective view of a first exemplary embodiment of the house number display system showing multiple number panels positioned with overlapping edges and within the transparent display window of the water-tight display housing and the optional combination power supply cord and illuminated door bell activation switch.

FIG. 1 shows a first exemplary embodiment of the house number display system generally designated 10. House number display system 10 includes multiple number panels 12 positioned within a housing compartment formed by a front housing portion 14 and a rear housing portion 16 and viewable through a transparent display window 18 formed through front housing portion 14. In this embodiment a power supply cord 20 is included that has an illuminated door bell activation switch 22 wired in connection with a conventional two conductor wire to allow a low voltage illumination source within the housing compartment to be powered through a door bell power supply.

Figure 2:
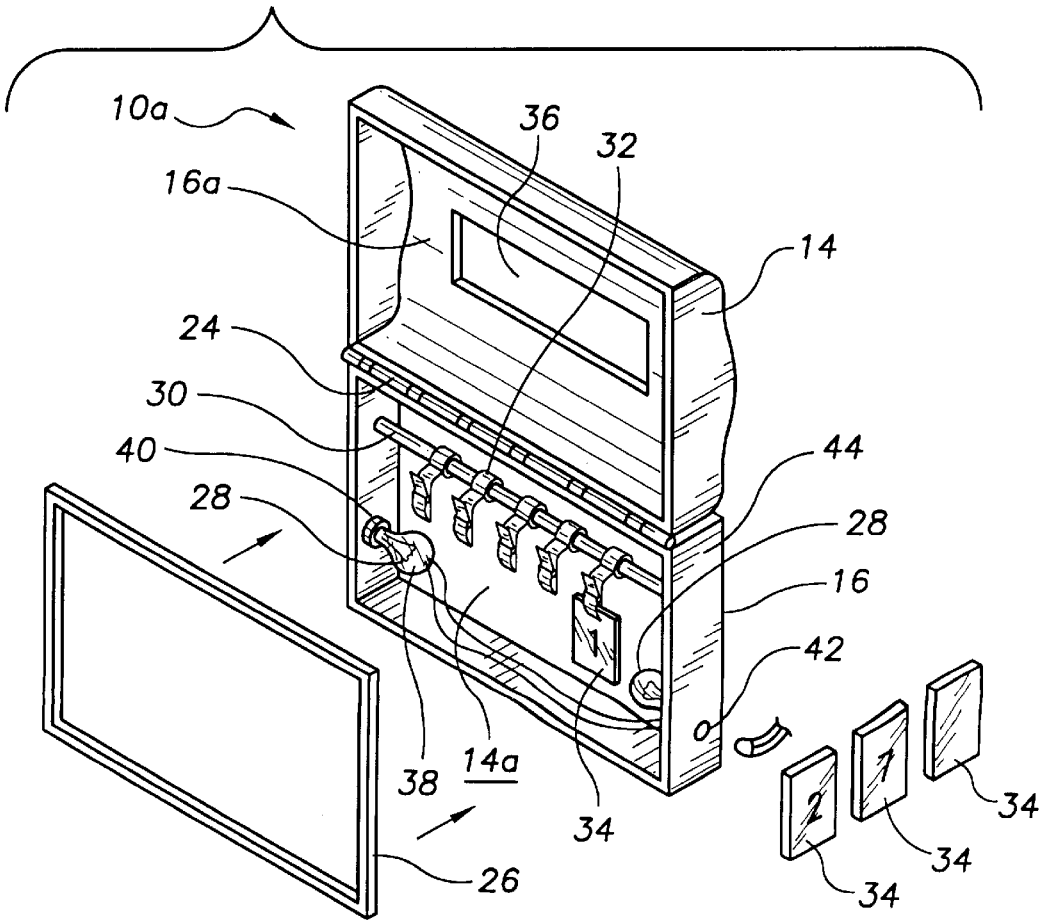
FIG. 2 is a perspective view of a second exemplary embodiment of the house number display system showing the hinged, two-part, water-tight display housing in the open position showing the transparent window provided through the front housing portion; the optional resilient, double-sided, adhesive coated, housing sealing gasket; the hinge connecting the front housing portion and the rear housing portion; and the rear housing portion including the low voltage power connector socket, the two low voltage light assemblies, the clip support rod secured across the rear housing portion, five identical spring loaded number panel support clip assemblies slidably mounted on the clip support rod, and a representative number panel.

FIG. 2 shows a second exemplary embodiment of house number display system, generally designated 10*a*. House number display system 10*a* includes a front housing portion 14; a rear housing portion 16; a hinge 24 connected between front housing portion 14 and rear housing portion 16; a resilient, double-sided, adhesive coated, housing sealing gasket 26; two low voltage light assemblies 28; a plastic clip support rod 30; five identical spring loaded number panel support clip assemblies, generally designated 32; and multiple number panels 34. A transparent plastic window 36 is provided through the front housing portion 14. Each low voltage light assembly 28 includes a light bulb 38 and a socket 40. In this embodiment each socket 40 is wired in connection with a low voltage power connector socket 42 molded in connection with the exterior 44 of rear housing portion 16. Front housing portion 14 defines a front housing compartment portion 14*a* and rear housing portion 16 defines a rear housing compartment portion 16*a* that combine when front housing portion 14 and rear housing portion 16 are sealed to form a housing compartment.

Figure 3:
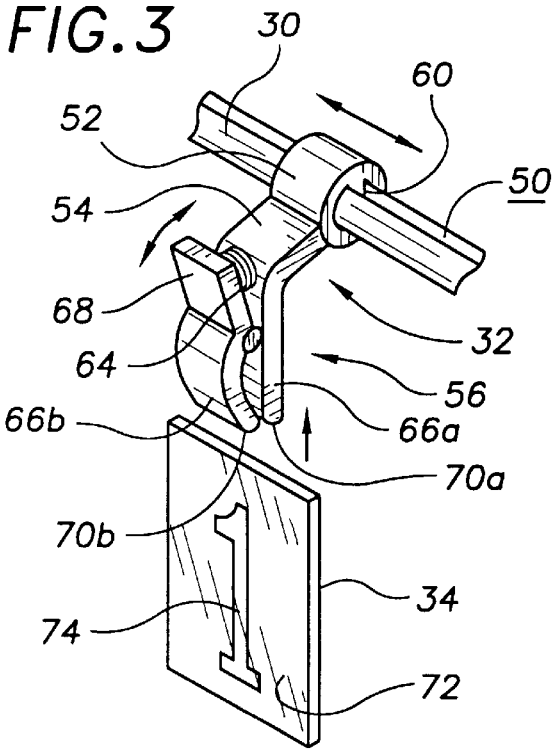
FIG. 3 is a detail perspective view showing one of the five identical spring loaded number panel support clip assemblies and a portion of the clip support rod showing the longitudinal guide channel formed into the clip support rod along the length thereof; the tube shaped clip mounting flange with the guide channel follower extending into the guide channel of the clip support rod to prevent rotation of the clip mounting flange about the clip support rod while allowing the clip support flange to slide back and forth along clip support rod; the horizontal clip extension portion extending away from the clip mounting flange; the spring biased number panel clip including the biasing spring, the clamping jaws, and the jaw opening tab; and a number panel including an opaque black background portion surrounding a transparent clear character portion.
Figure 3A:
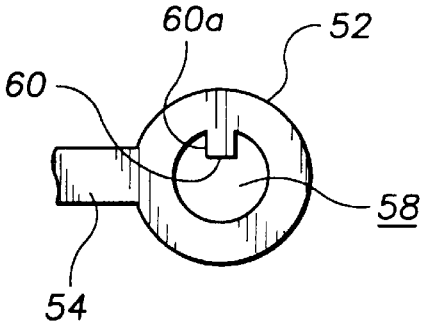
FIG. 3A is a top plan detail view showing the support rod insertion opening of the tube shaped clip mounting flange, the channel follower extending into the support rod insertion opening, and a section of the horizontal clip extension portion.

Referring to FIG. 3, clip support rod 30 is secured across the rear housing portion and has a longitudinal guide channel 50 formed along the length thereof. Each of the five spring loaded number panel support clip assemblies 32 is slidably mounted on clip support rod 30. Spring loaded number panel support clip assembly 32 includes a tube shaped clip mounting flange 52, a horizontal clip extension portion 54, and a spring biased number panel clip, generally designated 56. Referring to FIG. 3A, tube shaped clip mounting flange 52 defines a support rod insertion opening 58 sized to receive clip support rod 30 (FIG. 3) and includes a guide channel follower 60 that extends into support rod insertion opening 58. Guide channel follower 60 is dimensioned, with reference back to FIG. 3, to fit into and slide along guide channel 50 of clip support rod 30. Horizontal clip portion 54 is integrally molded with tube shaped clip mounting flange 52 and extends radially away therefrom at a right angle to a sidewall 60*a* (FIG. 3A) of guide channel follower 60 and terminates in connection with spring biased number panel clip 56. Spring biased number panel clip 56 includes a biasing spring 64, a pair of pivotally connected clamping jaws 66*a*,66*b*, and a jaw opening tab 68 integrally formed with clamping jaw 66*b*. Biasing spring 64 biases clamping jaw 66*b* toward clamping jaw 66*a*. Depressing jaw opening tab 68 causes clamping jaw 66*b* to pivot away from clamping jaw 66*a* creating a gap between jaw ends 70*a*,70*b* of sufficient size to insert a portion of a number panel 34 therebetween. When jaw opening tab 68 is released, number panel 34 is gripped between clamping jaws 66*a*,66*b*. In this embodiment each number panel 34 is a clear plastic panel that is screen printed with an opaque black ink to form an opaque background portion 72 surrounding a transparent clear character portion 74.

Figure 4:
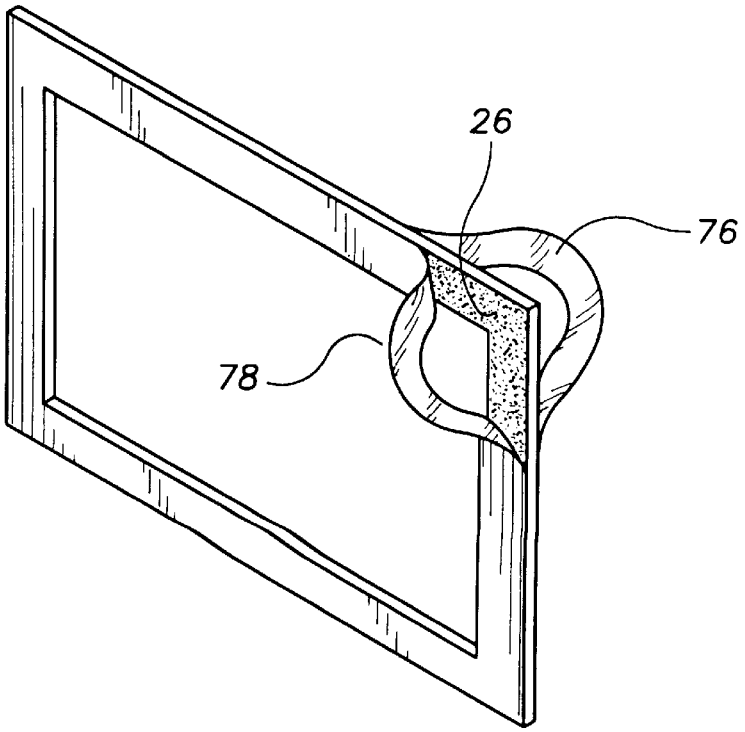
FIG. 4 is a perspective view of the optional resilient, double-sided, adhesive coated, housing sealing gasket of FIG. 2 showing the front and rear peel off covers partially peeled away from either side of the resilient housing sealing gasket.

Referring to FIG. 4, resilient, double-sided, adhesive coated, housing sealing gasket 26 is provided with first and second peel off cover members 76,78 to prevent the adhesive from sticking before the user can adapt housing system 10*a* (FIG. 2) to display a desired house or building number.

It can be seen from the preceding description that a house number display system has been provided that is attachable on or near a house or other building to identify the house or building; that includes at least one illumination source for illuminating the numbers identifying the building or house; that is rapidly adapted to display a specific house number; and that includes a front housing portion and a rear housing portion that are connected by a hinge and that are sealable together to define a housing compartment therein; a plurality of number panels; at least one low voltage light assembly installed within the housing compartment; a clip support rod secured across the rear housing portion and positioned within the housing compartment, and a plurality of identical spring loaded number panel support clip assemblies slidably mounted on the clip support rod; the clip support rod having a longitudinal guide channel formed along the length thereof; each of the plurality of identical spring loaded number panel support clip assemblies having a tube shaped clip mounting flange defining a support rod insertion opening and including a guide channel follower extending into the support rod insertion opening, and a horizontal clip extension portion extending radially away from the clip mounting flange and terminating in connection with a spring biased number panel clip including a biasing spring, clamping jaws, and a jaw opening tab; the biasing spring biasing the clamping jaws into a closed position; the jaw opening tab being in connection with one of the jaws such that depressing the jaw opening tab causes the clamping jaws to separate; each of the plurality of identical spring loaded number panel support clip assemblies being slidably mounted on the clip support rod such that the guide channel follower of each tube shaped clip mounting flange is slidably entrapped within the longitudinal guide channel preventing rotation of the clip mounting flange about the clip support rod while allowing the clip support flange to slide back and forth along the clip support rod; each number panel including an opaque background portion surrounding a transparent clear character portion; the opaque background portion being partially insertable between the clamping jaws of one of the spring biased number panel clips.

It is noted that the embodiment of the house number display system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A house number display system comprising:

a front housing portion having a transparent window;

a rear housing portion connected by a hinge to said front housing portion, said front housing portion and said rear housing portion being sealable together to define a housing compartment therein;

a plurality of number panels positionable within said housing compartment and viewable through said transparent window;

at least one low voltage light assembly installed within said housing compartment;

a clip support rod secured across said rear housing portion and positioned within said housing compartment; and a plurality of identical spring loaded number panel support clip assemblies slidably mounted on said clip support rod;

said clip support rod having a longitudinal guide channel formed along the length thereof;

each of said plurality of identical spring loaded number panel support clip assemblies having a tube shaped clip mounting flange defining a support rod insertion opening and including a guide channel follower extending into said support rod insertion opening, and a horizontal clip extension portion extending radially away from said clip mounting flange and terminating in connection with a spring biased number panel clip including a biasing spring, clamping jaws, and a jaw opening tab;

said biasing spring biasing said clamping jaws into a closed position;

said jaw opening tab being in connection with one of said jaws such that depressing said jaw opening tab causes said clamping jaws to separate;

each of said plurality of identical spring loaded number panel support clip assemblies being slidably mounted on said clip support rod such that said guide channel follower of each tube shaped clip mounting flange is slidably entrapped within said longitudinal guide channel preventing rotation of said clip mounting flange about said clip support rod while allowing said clip mountain flange to slide back and forth along said clip support rod;

each number panel including an opaque background portion surrounding a transparent clear character portion;

said opaque background portion being partially insertable between said clamping jaws of one of said spring biased number panel clips;

each of said spring biased number panel clips being positionable along said clip support rod such that a number panel held thereby is visible through said transparent window of said front housing portion.

2. The house number display system of claim 1, further comprising:

a resilient housing sealing gasket having adhesive on either side thereof that is positionable between said front housing portion and said rear housing portion to provide a water-tight seal therebetween.

3. The house number display system of claim 2, wherein:

said housing sealing gasket includes a first peel off cover on a first side thereof and a second peel off cover on a second side thereof.

4. The house number display system of claim 3 wherein:

said low voltage light assembly includes a power supply cord having an illuminated doorbell switch wired in connection therewith.

5. The house number display system of claim 4 wherein:

said low voltage light assembly includes a low voltage electrical connector formed in connection with an exterior surface of said rear housing portion.

6. The house number display system of claim 3 wherein:

said low voltage light assembly includes a low voltage electrical connector formed in connection with an exterior surface of said rear housing portion.

7. The house number display system of claim 2 wherein:

said low voltage light assembly includes a power supply cord having an illuminated doorbell switch wired in connection therewith.

8. The house number display system of claim 7 wherein:

said low voltage light assembly includes a low voltage electrical connector formed in connection with an exterior surface of said rear housing portion.

9. The house number display system of claim 2 wherein:

said low voltage light assembly includes a low voltage electrical connector formed in connection with an exterior surface of said rear housing portion.

10. The house number display system of claim 1 wherein:

said low voltage light assembly includes a power supply cord having an illuminated doorbell switch wired in connection therewith.

11. The house number display system of claim 10 wherein:

said low voltage light assembly includes a low voltage electrical connector formed in connection with an exterior surface of said rear housing portion.

12. The house number display system of claim 1 wherein:

said low voltage light assembly includes a low voltage electrical connector formed in connection with an exterior surface of said rear housing portion.

* * * * *